US008302253B2

(12) United States Patent
Ni

(10) Patent No.: US 8,302,253 B2
(45) Date of Patent: Nov. 6, 2012

(54) CYCLONE SEPARATION DUST CUP AND VACUUM CLEANER USING THE SAME

(75) Inventor: Zugen Ni, Jiangsu Province (CN)

(73) Assignee: Suzhou Kingclean Floorcare Co., Ltd., Suzhou (CN)

( * ) Notice: Subject to any disclaimer, the term of this patent is extended or adjusted under 35 U.S.C. 154(b) by 345 days.

(21) Appl. No.: 12/750,936

(22) Filed: Mar. 31, 2010

(65) Prior Publication Data

US 2010/0251508 A1 Oct. 7, 2010

(30) Foreign Application Priority Data

Apr. 1, 2009 (CN) ..... 2009 2 0142330 U

(51) Int. Cl.
*A47L 9/10* (2006.01)
*A47L 9/20* (2006.01)

(52) U.S. Cl. ..... 15/353; 55/429; 55/DIG. 3

(58) Field of Classification Search ..... 15/351, 15/355; 55/377, DIG. 3, 428, 429
See application file for complete search history.

(56) References Cited

U.S. PATENT DOCUMENTS

| | | | | |
|---|---|---|---|---|
| 6,579,334 | B2 * | 6/2003 | Oh et al. | 55/426 |
| 6,874,197 | B1 * | 4/2005 | Conrad et al. | 15/353 |
| 2005/0252179 | A1 * | 11/2005 | Oh et al. | 55/337 |
| 2006/0236663 | A1 * | 10/2006 | Oh | 55/337 |
| 2009/0056290 | A1 * | 3/2009 | Oh et al. | 55/337 |
| 2009/0178233 | A1 * | 7/2009 | Yoo | 15/350 |
| 2009/0178568 | A1 * | 7/2009 | Yoo | 96/416 |

* cited by examiner

*Primary Examiner* — Brian Glessner
*Assistant Examiner* — Brian D Mattei
(74) *Attorney, Agent, or Firm* — Birch, Stewart, Kolasch & Birch, LLP

(57) ABSTRACT

A cyclone separation dust cup, which includes a cup body and a cyclone tube, the cyclone tube being provided with an air inlet, an ash ejection outlet, and an air exhaust outlet; and the ash ejection outlet communicates with a dust storage cavity in the cup body, the air exhaust outlet with an air outlet positioned on the cup body through an air exhaust pipe, and the dust storage cavity with the air exhaust pipe. The dust storage cavity, by communicating with the air exhaust pipe, enables part of the air current entering the cyclone tube to enter the dust storage cavity in the cup body, thus producing suction in the ash ejection outlet of the cyclone tube that can draw the dust into the dust storage cavity. This enables the impurities with a lighter weight (e.g. hair and downy floc), which cannot fall into the dust storage cavity under gravity, to be inhaled into the dust storage cavity successfully, thus greatly improving the separating and filtering effect of this cyclone separation dust cup.

12 Claims, 7 Drawing Sheets

A Enlarged view

B Enlarged view

CYCLONE SEPARATION DUST CUP AND VACUUM CLEANER USING THE SAME

FIELD OF THE INVENTION

The present invention relates to a cyclone separation dust cup and a vacuum cleaner using the same.

BACKGROUND OF THE INVENTION

A cyclone separation dust cup is a device that separates dust by making use of the centrifugal force. It is provided inside with a cyclone tube, which is provided at the side tube body with an air inlet in the tangent direction. Dust-laden air performs spiral movement after entering the cyclone tube through this air inlet, which makes most of the dust ejected out in the tangent direction under the centrifugal force and fall into a dust storage cavity in the cup body. Then the air enters an air exhaust pipe through a conical filter screen cover, and is finally exhausted out of the dust cup.

However, the prior cyclone separation dust cup is poor at separating and filtering impurities in the dust with lighter weight (e.g. hair and downy floc). It is because such impurities (e.g. hair and downy floc), although separated away under the centrifugal force, cannot fall into the dust storage cavity of the cup body successfully under gravity like those impurities with larger grain size due to their weighing so light themselves, and can only hover afloat in the cyclone tube with the air current. This will not only prevent other impurities from being filtered away, but also usually intercepted by the conical filter screen cover, which will result in clogging of the conical filter screen cover, unsmoothness of the air current, and even increase of power consumption of the vacuum motor of the vacuum cleaner.

CONTENTS OF THE INVENTION

The purpose of the present invention is to provide a cyclone separation dust cup better at separating and filtering dust, which particularly enables such lighter impurities as hair and downy floc to be separated away and fall into a dust storage cavity successfully.

A technical solution of the present invention is as below: A cyclone separation dust cup is provided, including a cup body and a cyclone tube, the cyclone tube being provided with an air inlet, an ash ejection outlet, and an air exhaust outlet; and the ash ejection outlet communicates with a dust storage cavity in the cup body, the air exhaust outlet with an air outlet positioned on the cup body through an air exhaust pipe, and the dust storage cavity with the air exhaust pipe.

A further technical solution of the present invention based on the above-mentioned main technical solution is as below: The cyclone tube, fixed above the cup body through a connection support, is positioned transversely relative to the cup body; the connection support is provided with an ash ejection exit and an air exhaust exit opposite to the ash ejection outlet and the air exhaust outlet, respectively; and the air exhaust pipe, positioned in the cup body, communicates with the air exhaust exit, at the communication site being provided a passage communicating with the dust storage cavity and the air exhaust pipe.

A more detailed technical solution of the present invention based on the above-mentioned further technical solution is as below: The air exhaust exit is provided at the periphery with two concentric annular convex ribs; the air exhaust pipe is provided at the top periphery with a circle of teeth extending along the axial direction, each of the teeth being partly propped into a pressed groove formed between the two annular convex ribs; meanwhile the connection support is further provided with an annular pressed cover wrapped around periphery of the air exhaust pipe, which is provided at the periphery with some pressed ribs and a circular platform connected with the pressed rib at the bottom, the pressed rib being propped against the internal wall of the annular pressed cover, there being a clearance between the bottom of the annular pressed cover and the circular platform; and the dust storage cavity communicates with the air exhaust pipe sequentially through the clearance, a cavity between the annular pressed cover and the air exhaust pipe, and a gap between the two adjacent teeth.

Besides, in the present invention the cyclone tube is provided inside with a conical filter screen cover dividing the internal tube cavity into a cyclone cavity and an air exhaust cavity; and the air inlet communicates with the environment and the cyclone cavity, the ash ejection outlet with the internal cup cavity and the cyclone cavity, and the air exhaust outlet with the air outlet and the air exhaust cavity through the air exhaust pipe.

Moreover, in the present invention the air outlet is positioned at the bottom of the cup body, and the air exhaust pipe, perpendicularly through the cup body, is positioned between the ash ejection outlet and the air exhaust outlet on the cyclone tube.

Another purpose of the present invention is to provide a vacuum cleaner using the above-mentioned cyclone separation dust cup. This vacuum cleaner includes a floor brush; the cyclone tube of the cyclone separation dust cup, fixed at the upper part of the cup body, is positioned transversely relative to the cup body; and the cup body is positioned vertically and fixed onto the floor brush. Because the cyclone tube is positioned transversely relative to the cup body, dust filtered away by the cyclone will fall lengthways into the internal cup cavity under gravity when the cup body is installed perpendicularly on the vacuum cleaner, without obstructing the air current flowing out transversely in the cyclone tube. Therefore, when such a vacuum cleaner is working, its internal air current is smoother, the wind velocity higher, and power consumption of the vacuum motor decreased greatly.

Besides, as in the above-mentioned vacuum cleaner, an HEPA filter device can further be provided at the downstream site of the air outlet on the cup body, so as to perform secondary filtering on the air exhausted out of the cup body and improve the dust filtering quality.

The present invention has the following advantages:

1. This cyclone separation dust cup of the present invention, with the dust storage cavity communicating with the air exhaust pipe, enables part of the air current entering the cyclone tube to enter the dust storage cavity in the cup body, thus producing a suction in the ash ejection outlet of the cyclone tube that can inhale the dust into the dust storage cavity. This makes the impurities with lighter weight (e.g. hair and downy floc), which cannot fall into the dust storage cavity under gravity, be inhaled into the dust storage cavity successfully, thus greatly improving the separating and filtering effect of this cyclone separation dust cup.
2. In this cyclone separation dust cup of the present invention, with the cyclone tube further positioned transversely relative to the cup body, the dust filtered away by the cyclone will fall lengthways into the internal cup cavity under gravity when the cup body is installed perpendicularly on the vacuum cleaner, without obstructing the air current flowing out transversely in the cyclone tube. Compared with the prior cyclone separation dust cup, this cyclone separation dust cup of the present invention can make the air current in the vacuum cleaner smoother, the wind velocity higher, and thus the power consumption of the vacuum motor in the vacuum cleaner decreased greatly.

3. Meanwhile the present invention provides a vacuum cleaner using the above-mentioned cyclone separation dust cup. This vacuum cleaner is not only good at dust separating and filtering, but also smooth in the air current, high in the wind velocity, and lower in the power consumption of the internal vacuum motor.

BRIEF DESCRIPTION OF THE DRAWINGS

The present invention will further be described below with reference to drawings and embodiments.

Figure 1:
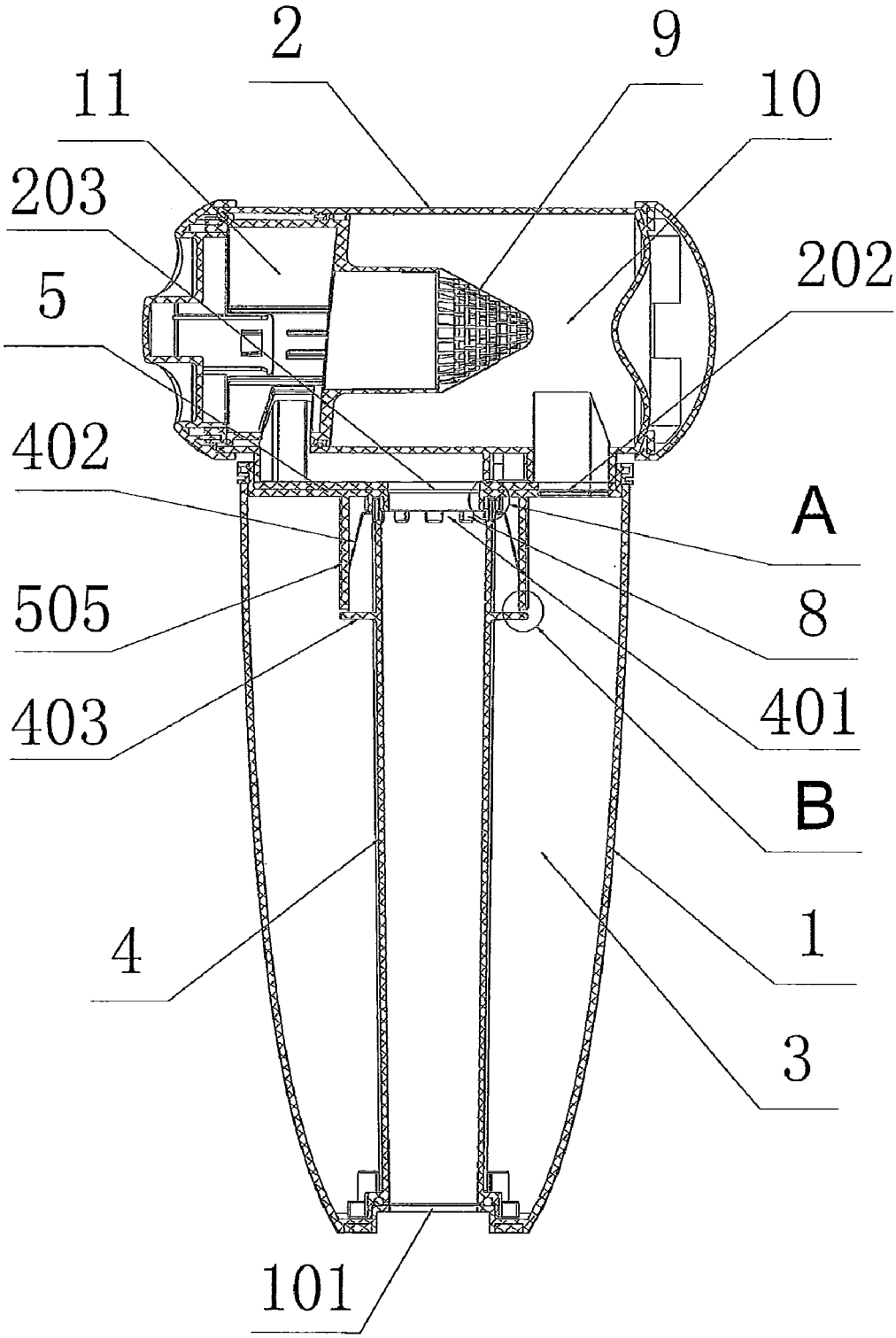
FIG. 1 is a structural sectional view of an embodiment of the cyclone separation dust cup of the present invention.
Figure 2:
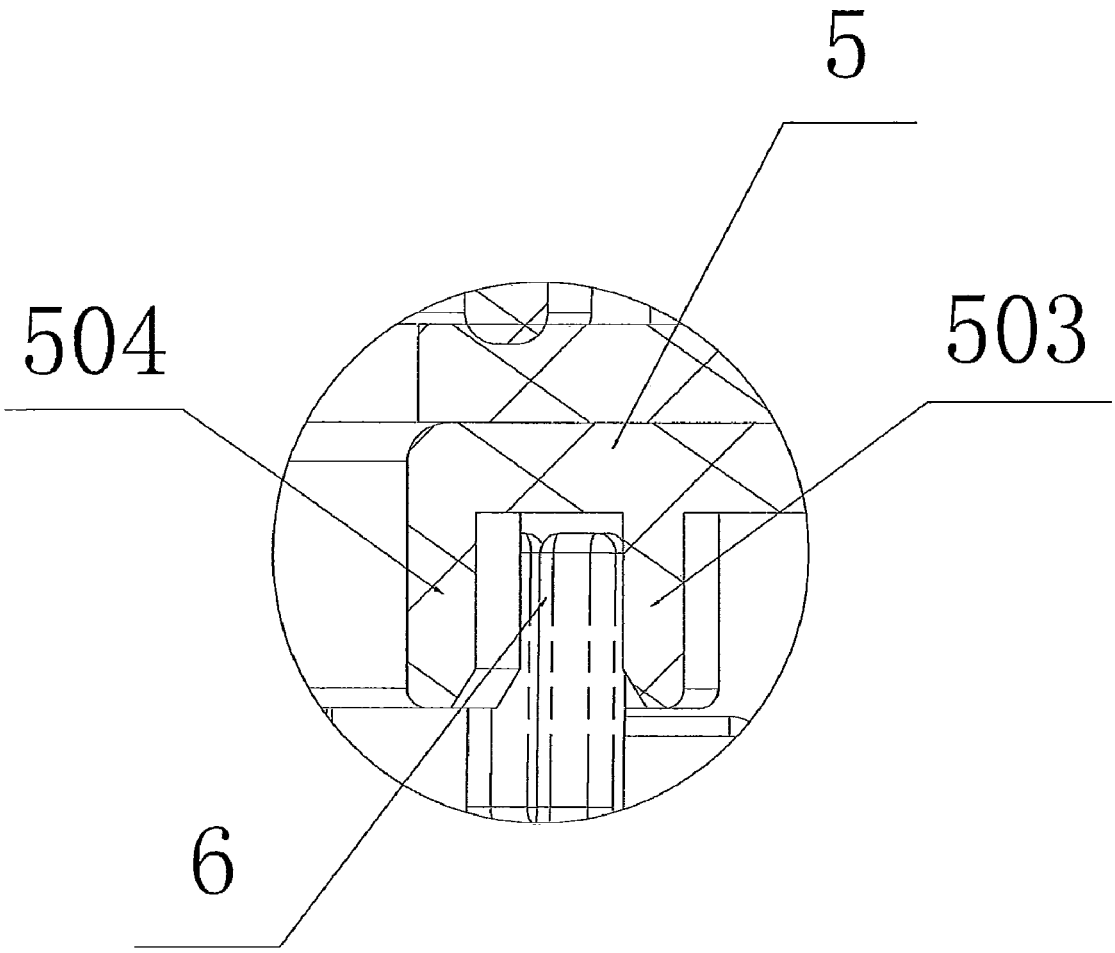
FIG. 2 is a partial enlarged schematic view of FIG. 1.
Figure 3:
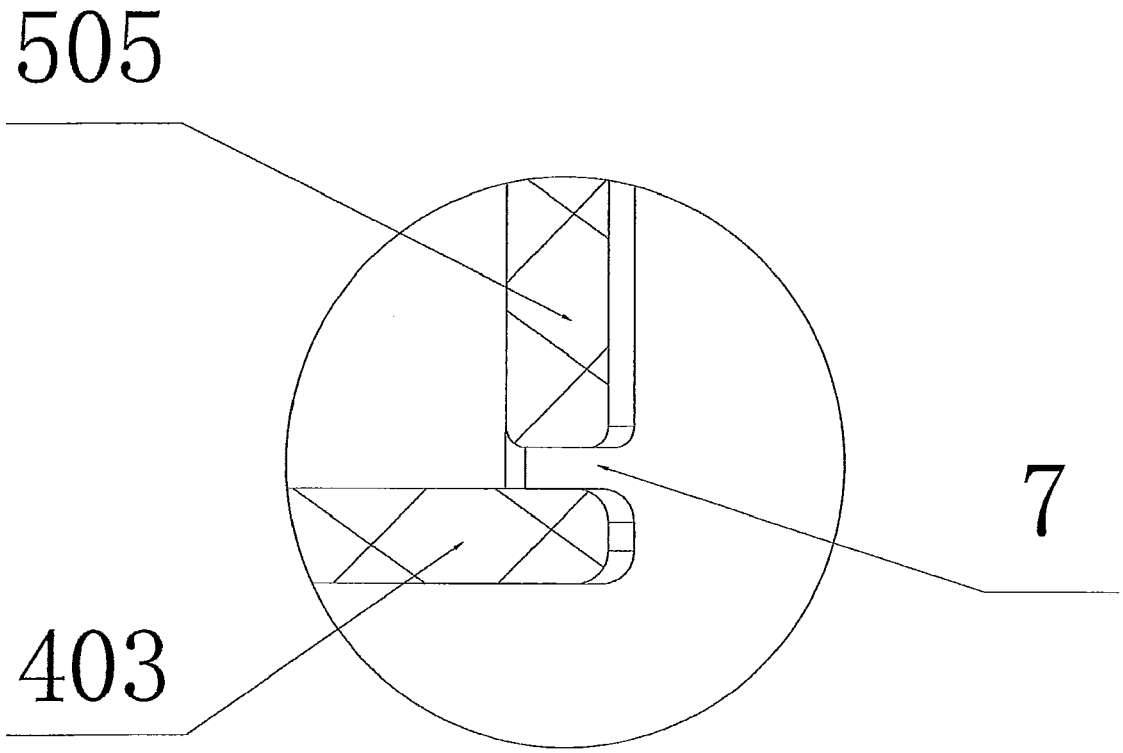
FIG. 3 is another partial enlarged schematic view of FIG. 1.
Figure 4:
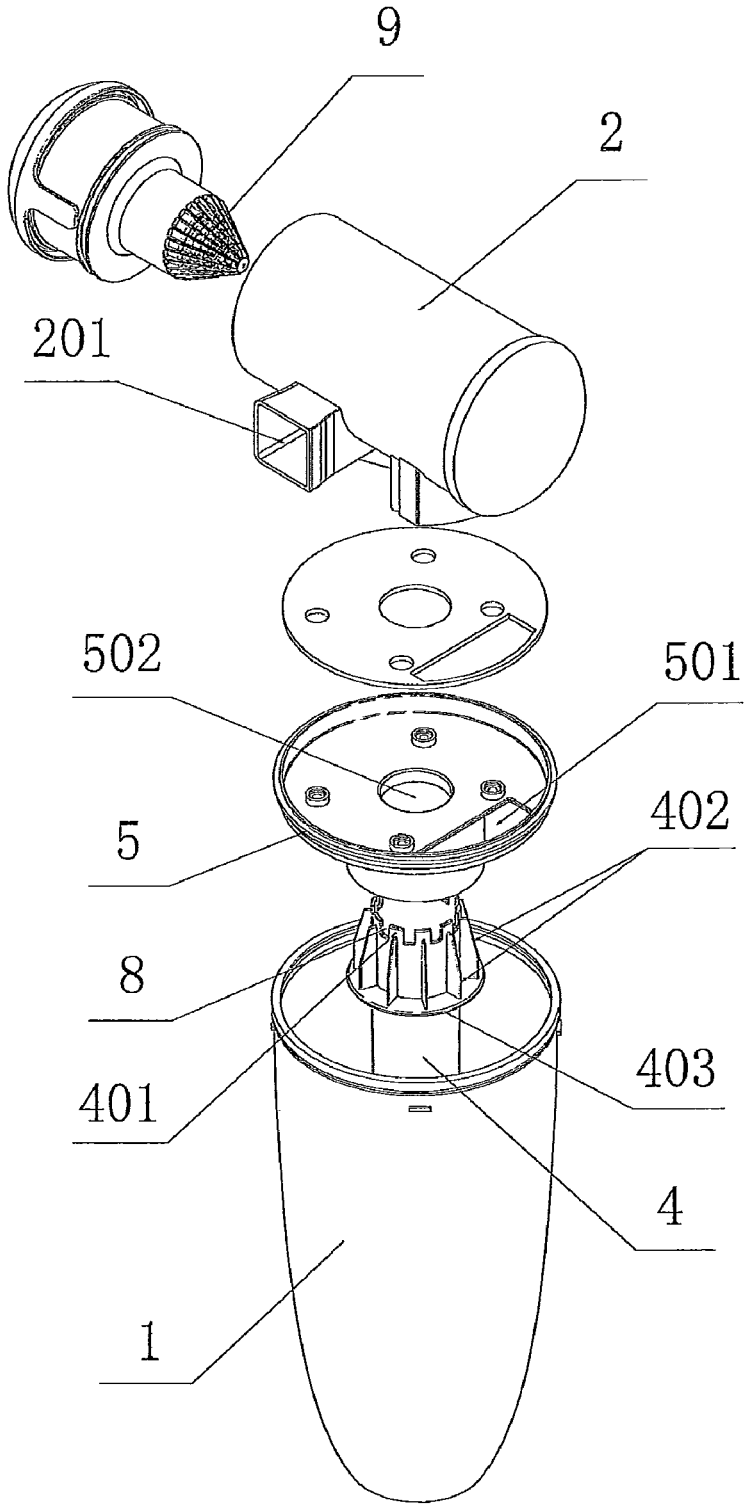
FIG. 4 is a stereoscopic exploded structural schematic view of the embodiment in FIG. 1.
Figure 5:
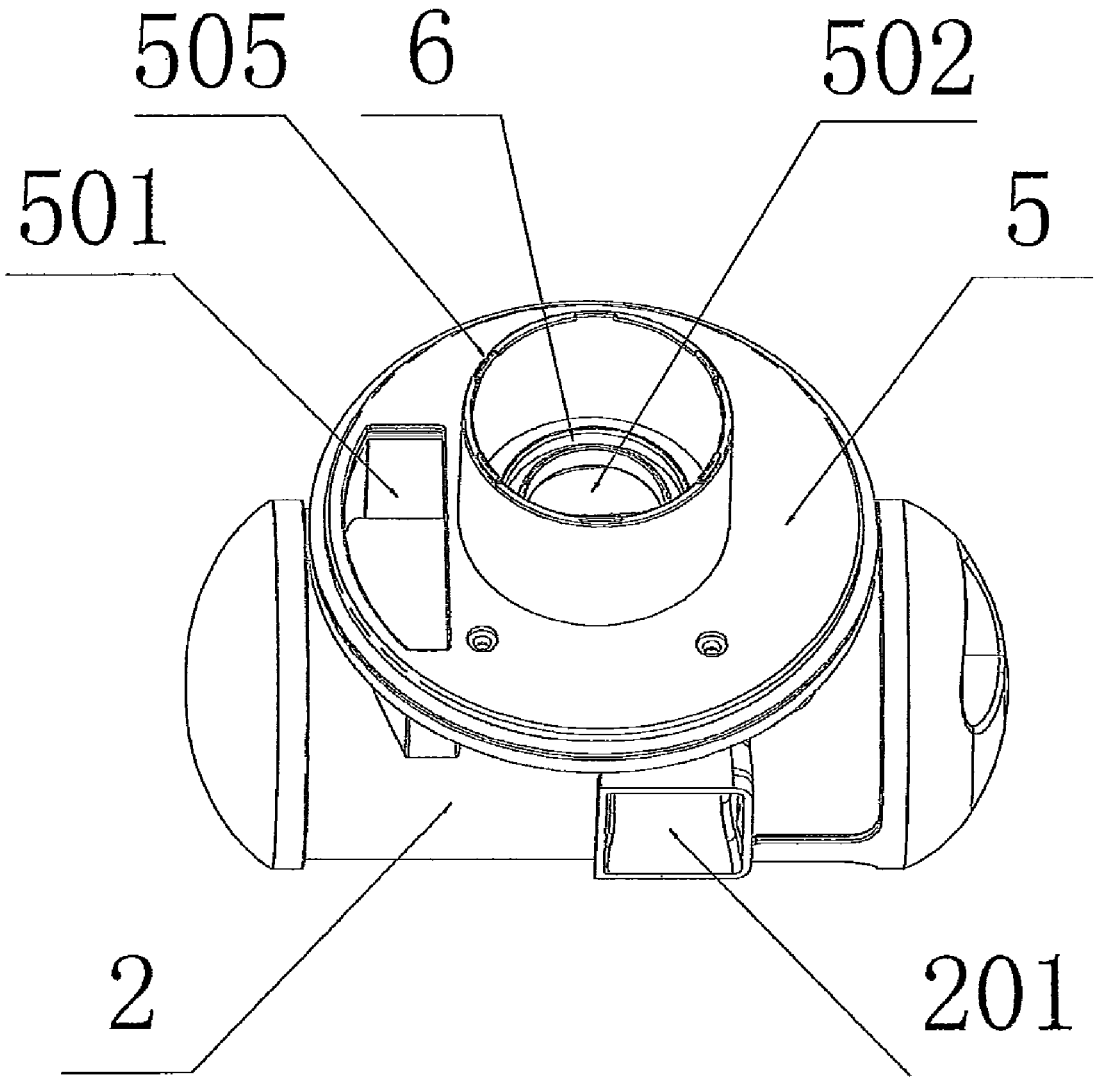
FIG. 5 is a structural schematic view of the cyclone tube and the connection support in FIG. 4 that are connected with each other.
Figure 6:
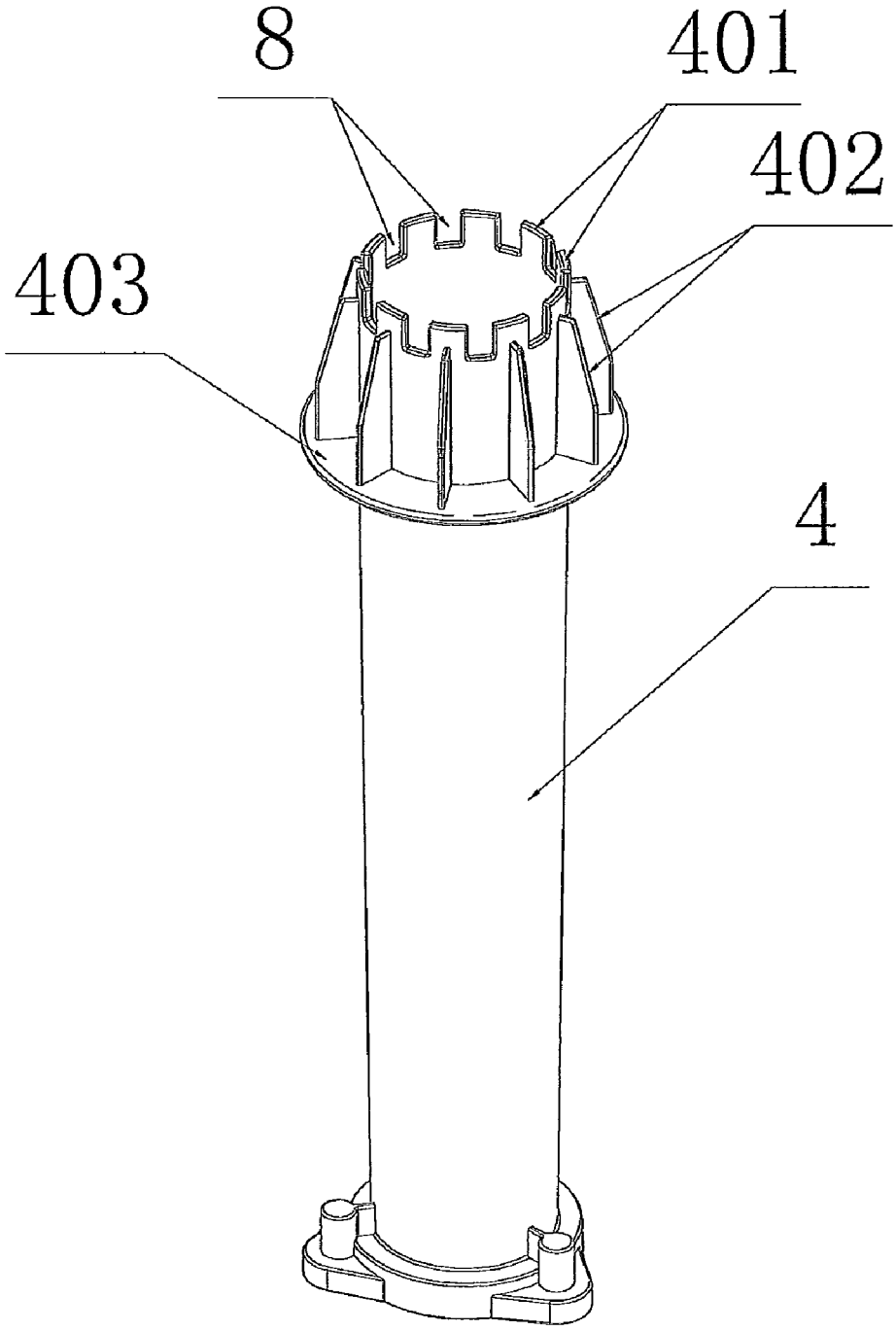
FIG. 6 is a separate structural schematic view of the air exhaust pipe in FIG. 4.

In the drawings: 1. Cup body; 101. air outlet; 2. cyclone tube; 201. air inlet; 202. ash ejection outlet; 203. air exhaust outlet; 3. dust storage cavity; 4. air exhaust pipe; 401. tooth; 402. pressed rib; 403. circular platform; 5. connection support; 501. ash ejection exit; 502. air exhaust exit; 503. annular convex rib; 504. annular convex rib; 505. annular pressed cover; 6. pressed groove; 7. clearance; 8. gap; 9. conical filter screen cover; 10. cyclone tube; 11. air exhaust cavity; 12. floor brush; 13. operating handle; and 14. flexible pipe joint.

DETAILED DESCRIPTION OF THE EMBODIMENTS

Embodiment: An embodiment of the cyclone separation dust cup of the present invention, as shown in FIGS. 1 to 6, includes a cup body 1 and a cyclone tube 2. The cyclone tube 2, fixed above the cup body 1 through a connection support 5, is positioned transversely relative to the cup body 1 (which means the axis of the cyclone tube 2 is perpendicular to the axis of the cup body 1). The cup body 1 is provided at the bottom with an air outlet 101, and the cyclone tube 2 is provided on the tube body with an air inlet 201, an ash ejection outlet 202, and an air exhaust outlet 203. In the tube body is fixed a conical filter screen cover 9 dividing the internal tube cavity into a cyclone cavity 10 and an air exhaust cavity 11. The air inlet 201 communicates with the environment and the cyclone cavity 10. The ash ejection outlet 202 communicates with the cyclone cavity 10 and a dust storage cavity 3 positioned in the cup body 1. The air exhaust outlet 203 communicates with the air outlet 101 and the air exhaust cavity 11 through an air exhaust pipe 4 that, perpendicularly through the cup body 1, is positioned between the ash ejection outlet 202 and the air exhaust outlet 203 on the cyclone tube.

The connection support 5 is provided with an ash ejection exit 501 and an air exhaust exit 502 opposite to the ash ejection outlet 202 and the air exhaust outlet 203, respectively. The air exhaust exit 502 is provided at the periphery with two concentric annular convex ribs 503 and 504. The air exhaust pipe 4 is provided at the top periphery with a circle of teeth 401*s* extending along the axial direction, each of the teeth 401*s* being partly propped into a pressed groove 6 formed between the two annular convex ribs 503 and 504. Meanwhile the connection support 5 is further provided with an annular pressed cover 505 wrapped around periphery of the air exhaust pipe 4, which is provided at the periphery with some pressed ribs 402*s* and a circular platform 403 connected with the pressed rib 402 at the bottom, the pressed rib 402 being propped against the internal wall of the annular pressed cover 505, there being a clearance 7 between the bottom of the annular pressed cover 505 and the circular platform 403. The dust storage cavity 3 communicates with the air exhaust pipe 4 sequentially through the clearance 7, a cavity between the annular pressed cover 505 and the air exhaust pipe 4, and a gap 8 between the two adjacent teeth 401*s*.

When this cyclone separation dust cup of the present invention is working, identical with the prior art, the dust-laden air enters the cyclone cavity 10 from the air inlet 201, and is separated from the dust under the centrifugal force by performing spiral movement, with the dust falling into the dust storage cavity 3 in the cup body 1 through the ash ejection outlet 202. Meanwhile a passage is provided in this cyclone separation dust cup that communicates with the dust storage cavity 3 and the air exhaust pipe 4, which enables part of the air current entering the cyclone tube 2 to enter the dust storage cavity 3, thus producing a suction in the ash ejection outlet 202 of the cyclone tube 2 that can inhale the dust into the dust storage cavity 3. This makes the impurities with lighter weight (e.g. hair and downy floc), which cannot fall into the dust storage cavity 3 under gravity, be also inhaled into the dust storage cavity 3 successfully, thus improving the dust separating and filtering effect greatly.

Figure 7:
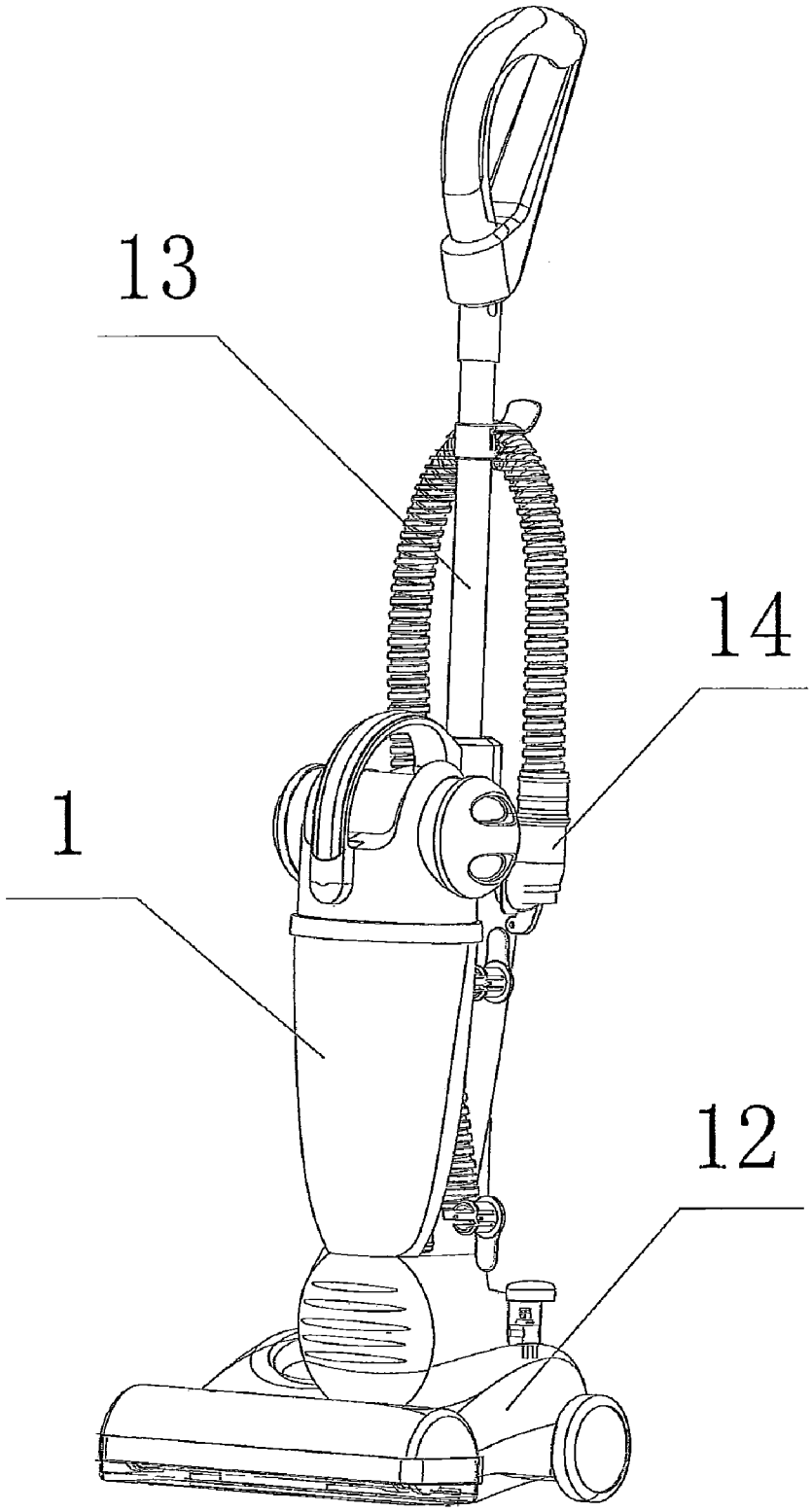
FIG. 7 is a vacuum cleaner provided with the cyclone separation dust cup in the embodiment of FIG. 1.

FIG. 7 is a whole structural schematic view of a vacuum cleaner using the above-mentioned cyclone separation dust cup. This vacuum cleaner is a vertical vacuum cleaner, including a floor brush 12 and an operating handle 13 movably connected with the floor brush 12. The cup body 1 of the cyclone separation dust cup is positioned lengthways and fixed on the floor brush 12. Meanwhile the operating handle 13 is provided with a flexible pipe joint 14 connected with the air inlet 201 of the cyclone tube 2, and the air outlet 101 on the cup body 1 communicates with a vacuum motor positioned in the floor brush 12 through an HEPA filter device (not shown in the drawing).

When this vertical vacuum cleaner is working, the dust-laden air enters the cyclone tube 2 from the air inlet 201 on the cyclone tube 2 and, after being primarily filtered through the cyclone cavity 10, flows transversely into the air exhaust cavity 11 through the conical filter screen cover 9. It is then exhausted out of the air outlet 101 on the cup body 1 through the air exhaust pipe 4 and, after being secondarily filtered by the HEPA filter device, finally flows into the vacuum motor in the floor brush 12.

This vertical vacuum cleaner, with the above-mentioned cyclone separation dust cup, can filter away dust and impurities effectively, particularly such impurities with lighter weight as hair and downy floc. Besides, it is further provided with the HEPA filter device at the downstream site of the air outlet 101 of the cup body 1 to perform secondary filtering on the air exhausted out of the cup body 1, thus improving the dust filtering quality greatly.

Meanwhile the cup body 1 of the cyclone separation dust cup used in the vacuum cleaner is positioned vertically, and the cyclone tube 2 transversely relative to the cup body 1, which make the dust filtered away by the primary cyclone in the cyclone tube 2 fall lengthways into the dust storage cavity 3 in the cup body 1 under gravity without obstructing the air current flowing out transversely in the cyclone tube 2. This doubtlessly makes the air current in this vertical vacuum cleaner smoother, the wind velocity also increased, and thus the power consumption of the vacuum motor in this vacuum cleaner decreased greatly.

What is claimed is:

1. A cyclone separation dust cup comprising:

a cup body and a cyclone tube, tube, the cyclone tube being provided with an air inlet, an ash ejection outlet, and an air exhaust outlet; and the ash ejection outlet communicates with a dust storage cavity in the cup body, and the air exhaust outlet communicates with an air outlet positioned on the cup body through an air exhaust pipe, wherein the dust storage cavity communicates with the air exhaust pipe; the cyclone tube, fixed above the cup body through a connection support, is positioned transversely relative to the cup body; the connection support is provided with an ash ejection exit and an air exhaust exit opposite to the ash ejection outlet and the air exhaust outlet, respectively; and the air exhaust pipe, positioned in the cup body, communicates with the air exhaust exit, at the communication site being positioned a passage communicating with the dust storage cavity and the air exhaust pipe.

2. The cyclone separation dust cup according to claim 1, wherein the air exhaust exit is provided at the periphery with two concentric annular convex ribs the air exhaust pipe is provided at the top periphery with a circle of teeth extending along the axial direction, each of the teeth being partly propped into a pressed groove formed between the two annular convex ribs; the connection support is further provided with an annular pressed cover wrapped around the periphery of the air exhaust pipe, which is provided at the periphery with pressed ribs and a circular platform connected with the pressed rib at the bottom, the pressed rib being propped against the internal wall of the annular pressed cover, there being a clearance between the bottom of the annular pressed cover and the circular platform; and the dust storage cavity communicates with the air exhaust pipe sequentially through the clearance, a cavity disposed between the annular pressed cover and the air exhaust pipe, and a gap disposed between the two adjacent teeth.

3. The cyclone separation dust cup according to claim 2, wherein the air outlet is positioned at the bottom of the cup body; and the air exhaust pipe, which extends perpendicularly through inside of the cup body; is positioned between the ash ejection outlet and the air exhaust outlet on the cyclone tube.

4. The vacuum cleaner using the cyclone separation dust cup according to claim 3, comprising a floor brush; wherein the cyclone tube of the cyclone separation dust cup, fixed at the upper part of the cup body; is positioned transversely relative to the cup body; and the cup body is positioned vertically and fixed on the floor brush.

5. The cyclone separation dust cup according to claim 2, wherein the cyclone tube is provided inside with a conical filter screen cover dividing the internal tube cavity into a cyclone cavity and an air exhaust cavity; and the air inlet communicates with the environment and the cyclone cavity; the ash ejection outlet with the internal cup cavity and the cyclone cavity; and the air exhaust outlet with the air outlet and the air exhaust cavity through the air exhaust pipe.

6. The vacuum cleaner using the cyclone separation dust cup according to claim 2, comprising a floor brush; wherein the cyclone tube of the cyclone separation dust cup, fixed at the upper part of the cup body; is positioned transversely relative to the cup body; and the cup body is positioned vertically and fixed on the floor brush.

7. The cyclone separation dust cup according to claim 1, wherein the cyclone tube is provided with a conical filter screen cover dividing the internal tube cavity into a cyclone cavity and an air exhaust cavity; and the air inlet communicates with the environment and the cyclone cavity, the ash ejection outlet with the internal cup cavity and the cyclone cavity, and the air exhaust outlet with the air outlet and the air exhaust cavity through the air exhaust pipe.

8. The vacuum cleaner using the cyclone separation dust cup according to claim 7, comprising a floor brush; wherein the cyclone tube of the cyclone separation dust cup, fixed at the upper part of the cup body; is positioned transversely relative to the cup body; and the cup body is positioned vertically and fixed on the floor brush.

9. A vacuum cleaner using the cyclone separation dust cup according to claim 1, comprising a floor brush; wherein the cyclone tube of the cyclone separation dust cup, fixed at the upper part of the cup body; is positioned transversely relative to the cup body; and the cup body is positioned vertically and fixed on the floor brush.

10. The vacuum cleaner according to claim 9, wherein an HEPA filter device is further provided at the downstream site of the air outlet on the cup body.

11. The cyclone separation dust cup according to claim 1, wherein the cyclone tube is provided with a conical filter screen cover dividing the internal tube cavity into a cyclone cavity and an air exhaust cavity; and the air inlet communicates with the environment and the cyclone cavity; the ash ejection outlet with the internal cup cavity and the cyclone cavity; and the air exhaust outlet with the air outlet and the air exhaust cavity through the air exhaust pipe.

12. The vacuum cleaner using the cyclone separation dust cup according to claim 1, comprising a floor brush; wherein the cyclone tube of the cyclone separation dust cup, fixed at the upper part of the cup body; is positioned transversely relative to the cup body; and the cup body is positioned vertically and fixed on the floor brush.

* * * * *